United States Patent [19]

Burkall et al.

[11] Patent Number: 4,462,170

[45] Date of Patent: Jul. 31, 1984

[54] SUMP FOR LINT SCREEN CLEANER AND STORAGE SYSTEM FOR A DRYER

[75] Inventors: Alvin E. Burkall, Coloma Township, Berrien County; Gerald L. Kretchman, St. Joseph Township, Berrien County, both of Mich.

[73] Assignee: Whirlpool Corporation, Benton Harbor, Mich.

[21] Appl. No.: 380,831

[22] Filed: May 21, 1982

[51] Int. Cl.[3] ..... F26B 11/02

[52] U.S. Cl. ..... 34/82; 34/133

[58] Field of Search ..... 34/82, 133; 55/290, 55/430, 431

[56] References Cited

U.S. PATENT DOCUMENTS

| | | | |
|---|---|---|---|
| 2,575,876 | 11/1951 | Kausch . | |
| 3,372,532 | 3/1968 | Campbell . | |
| 3,966,441 | 6/1976 | Freze . | |
| 4,294,597 | 10/1981 | Archer et al. | 55/290 |
| 4,314,409 | 2/1982 | Cartier et al. . | |

*Primary Examiner*—Larry I. Schwartz
*Assistant Examiner*—David W. Westphal
*Attorney, Agent, or Firm*—Hill, Van Santen, Steadman & Simpson

[57] ABSTRACT

An automatic lint screen cleaner in an automatic dryer is provided with a foreign objects sump which provides a means for removing foreign objects from the area of the lint screen cleaner while preventing lint build up in the sump.

5 Claims, 8 Drawing Figures

FIG. 7
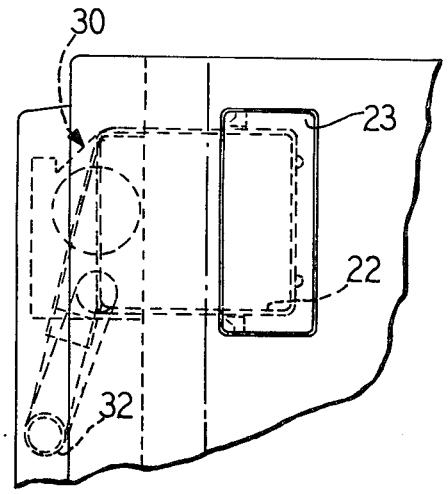
FIG. 8
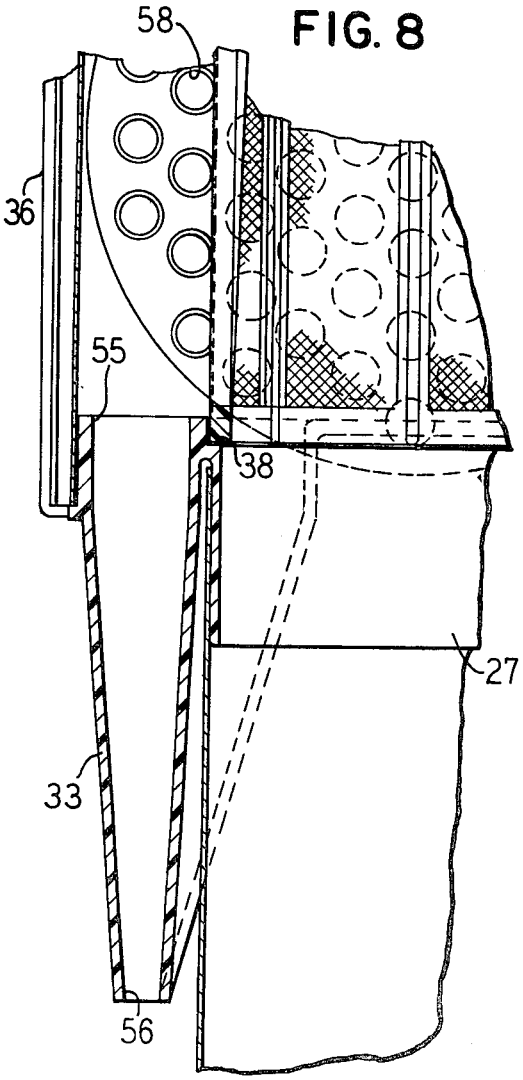
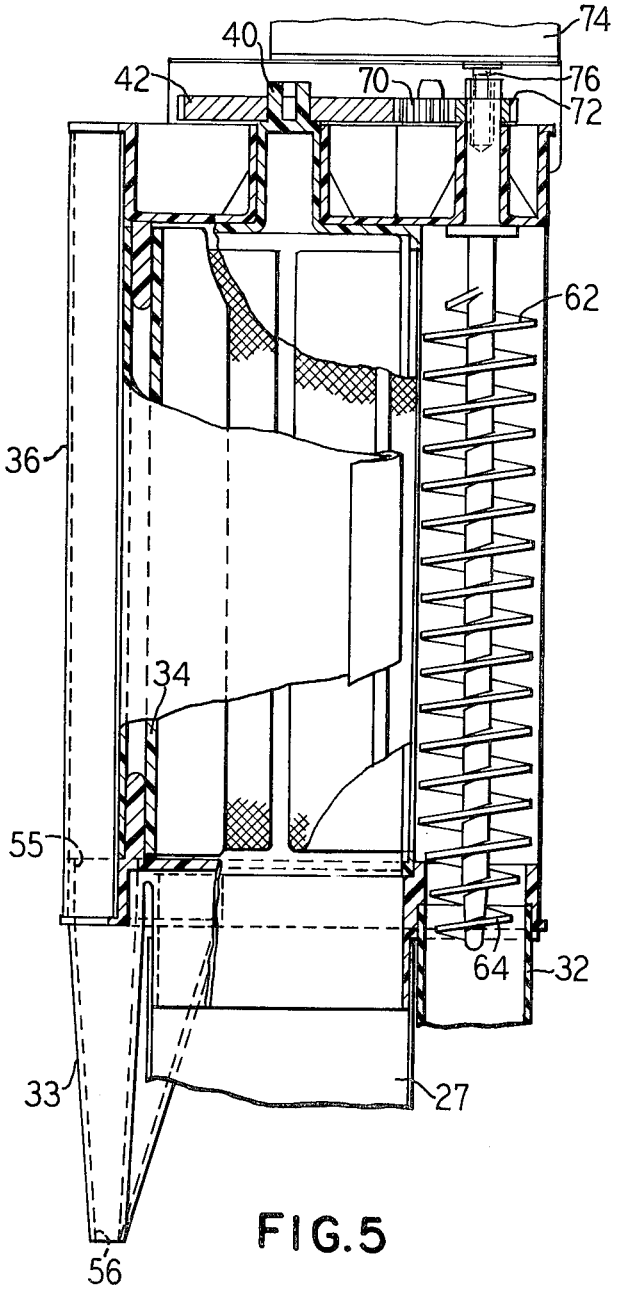
FIG. 5

SUMP FOR LINT SCREEN CLEANER AND STORAGE SYSTEM FOR A DRYER

BACKGROUND OF THE INVENTION

1. Field of the Invention

This invention relates to a means for cleaning a screen and more specifically to the automatic cleaning of a lint screen for use in an automatic clothes dryer.

2. Description of the Prior Art

A lint screen cleaner for use in an automatic clothes dryer is disclosed and claimed in U.S. Pat. No. 4,314,409. This patent discloses a means of automatically separating the lint continuously from the dryer exhaust air system, rolling it into string-like masses and passing it to a transport system. The transport system moves the lint to a storage receptacle which is accessible through a hinged panel in the machine top and which requires cleaning only approximately every two years under average conditions of household use.

That patent discloses a device which comprises a rotating cylindrical screen through which the dryer exhaust is continuously passed from the outside of the cylinder to the inside of the cylinder and which includes multiple wiper blades to roll the lint deposited on the screen into string-like masses as the screen is advanced. The released lint is passed to a rotating auger to be transported to a smooth walled plastic tube and into the storage receptacle in the upper right and upper left quadrant areas of the dryer cabinet.

U.S. Pat. No. 3,966,441 discloses a lint separating and disposal apparatus utilizing a rotating screen which passes the lint past a flame for burning and which includes one or more arcuate collector cups disposed in the wall of the shell below and radially outward from the screen structure for collecting particulate matter such as hair pins.

SUMMARY OF THE INVENTION

The present invention provides a sump portion for use with a means of automatically separating the lint continuously from the dryer exhaust air system which provides an area in the bottom of the dryer housing to catch foreign objects carried in the dryer exhaust air stream and to prevent failure of the lint separating mechanism due to jamming of the rotating screen or auger because of the foreign objects.

The invention comprises a cone-shape sump tapering down to one hole in the bottom of the sump of a size approximately the same as the drum outlet holes. This single hole keeps the sump area free of foreign objects and also keeps the sump area free of lint because air is drawn into the system through the hole due to the low pressure area created by the blower system which holds the lint against the rotating screen.

DESCRIPTION OF THE DRAWINGS

FIG. 5 is a fragmentary cross-sectional side view taken along line V—V of FIG. 4 including an elevational view of the auger.

FIG. 7 is a partial plan view of the dryer showing the access door for the lint storage area.

FIG. 8 is a detailed partial view of the sump area of the lint screen cleaner.

DESCRIPTION OF THE PREFERRED EMBODIMENTS

Figure 1:
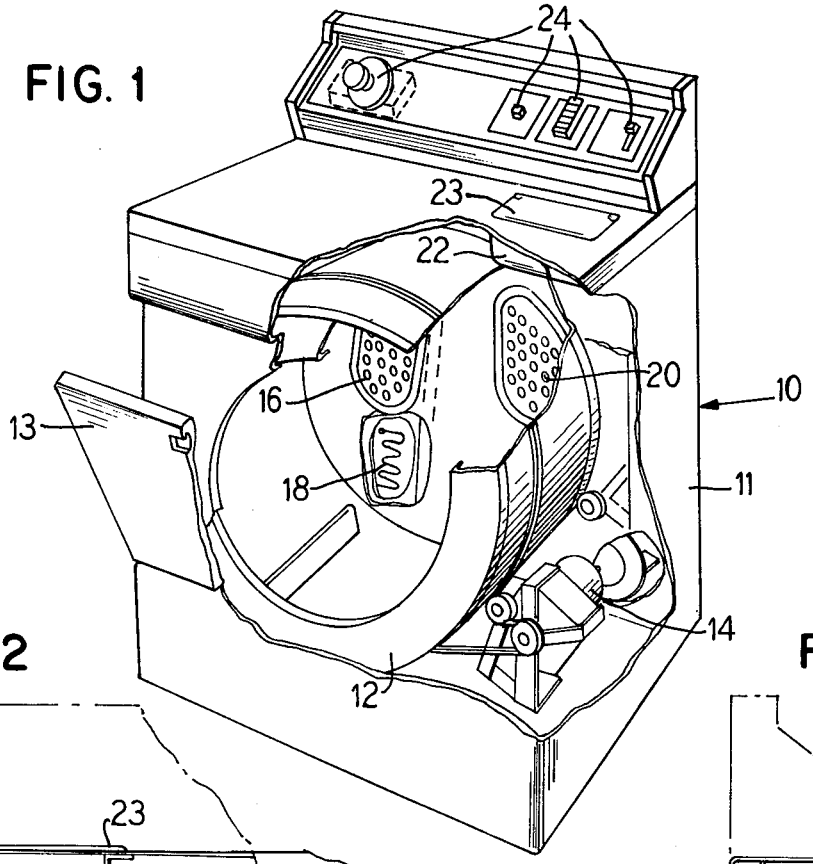
FIG. 1 is a perspective view of a dryer with a partial cut-away showing the electric motor, rotating drum, heater, air inlets and outlets, and a lint storage receptacle.

In FIG. 1 a clothes dryer is shown generally at 10 comprising a cabinet or housing 11, a rotating drum 12 for tumbling a clothes load, a door 13 to furnish access to the interior of the drum 12, an electrically driven motor 14 to rotate the drum 12, an air inlet 16 through which passes air heated by a heater 18 for use in drying the clothes load and which discharged through an exhaust air opening or outlet 20, a blower means 26 (FIG. 2) for circulating the heated air through the clothes load, a lint collecting receptacle 22 with access door 23 and controls 24 for use in setting the desired temperature of the heated air and the length of time of the drying cycle.

In accordance with the principles of the invention disclosed and claimed in U.S. Pat. No. 4,314,409, which is incorporated herein by reference, there is provided a means of automatically separating lint continuously from the dryer exhaust air stream, rolling it into string-like masses, releasing it from the continuously rotating screen where it is picked up by a gear coupled auger to be transported through a smooth walled plastic tube to the storage receptacle mounted in the upper area of the cabinet. Service access is through a hinged panel in the machine top or through a hinged top, thereby providing approximately 2 years of storage capability for the accumulated and compacted lint under normal operating conditions of household use.

In accordance with the principles of the present invention, it is contemplated that there will be provided a sump area adjacent the rotating screen to provide an area in the bottom of the housing to catch toothpicks, nails, screws, pins, etc. that if allowed to pass through the system would cause failure due to jamming of the rotating screen or auger.

Figure 2:
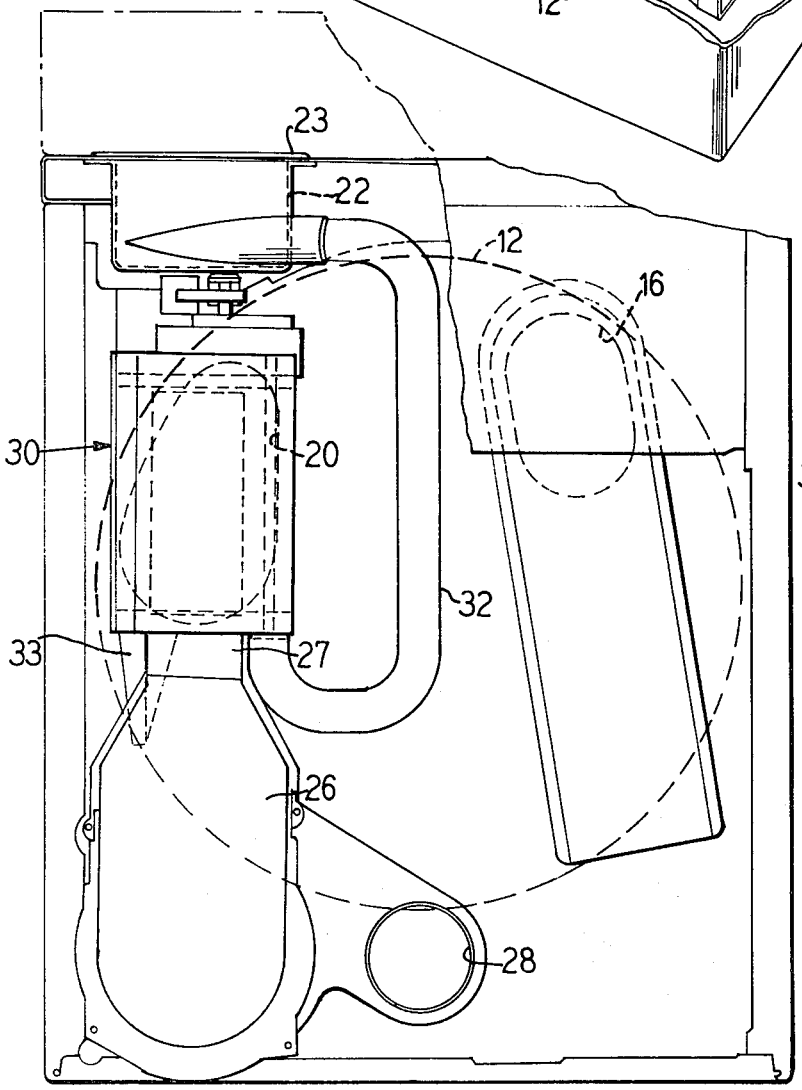
FIG. 2 is a back view of the dryer of FIG. 1 showing in phantom the storage receptacle, the rotating drum, the air inlet and air outlet and the lint collection system and sump of the present invention.

Shown in phantom in FIG. 2 is the air inlet 16 and exhaust air outlet 20 and also the blower means 26 having an inlet 27 and a discharge port 28. An automatic lint screen cleaner and storage mechanism shown generally at 30 is provided between the exhaust air outlet 20 and the discharge port 28. A lint transport tube 32 connects the automatic lint screen cleaner and storage mechanism 30 to the lint collecting receptacle 22. A phantom view of the back side of the drum 12 is also shown. A cone shaped sump 33 is shown partially in full and partially in phantom.

Figure 3:
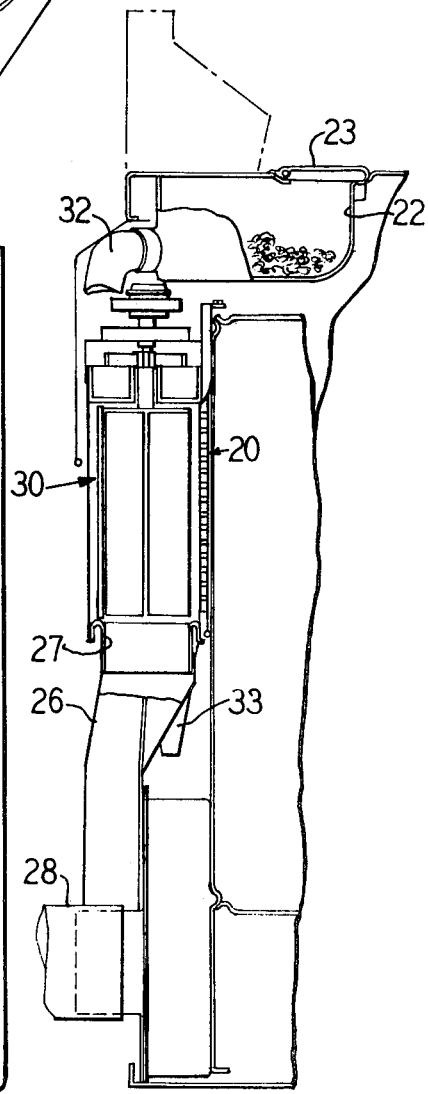
FIG. 3 is a partial cross-sectional side view of the dryer of FIG. 1 showing the placement of the lint screen cleaner and sump.
Figure 6:
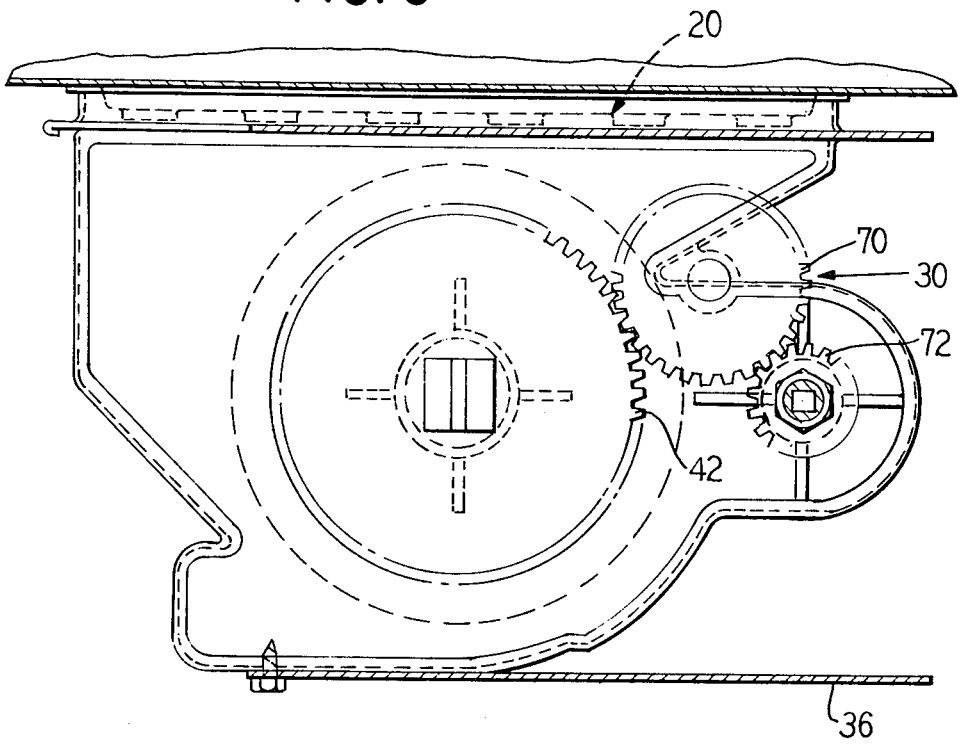
FIG. 6 is a plan view of the drive gear mechanism for the lint cleaner.
Figure 4:
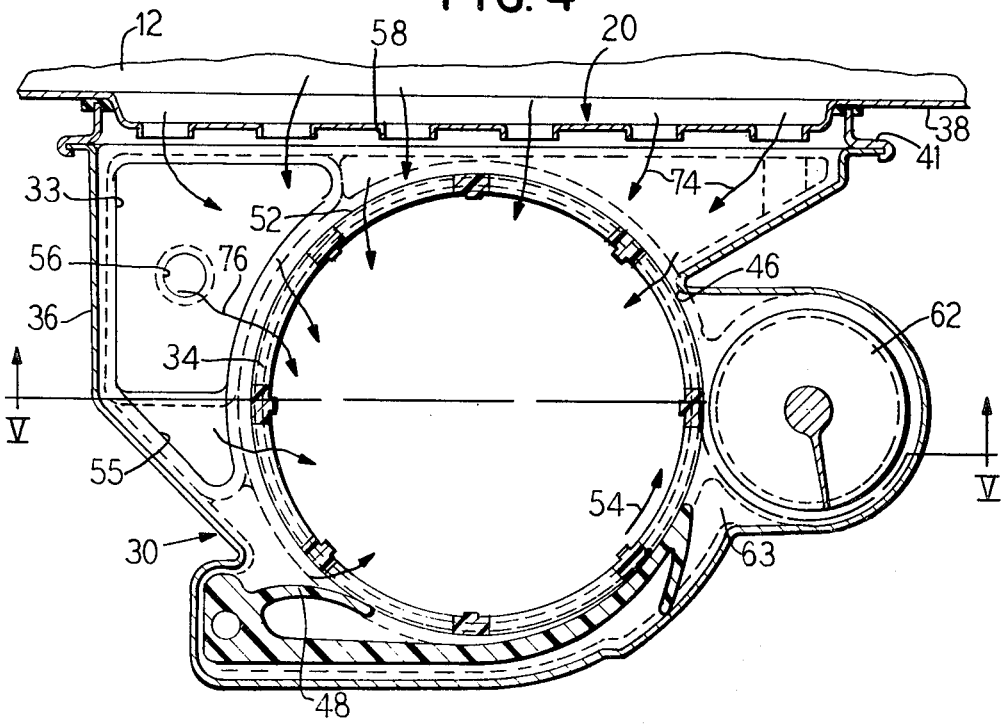
FIG. 4 is a cross-sectional plan view of the lint screen cleaner.

The automatic lint screen cleaner and storage mechanism 30 is shown in detail in FIGS. 3 through 8. Referring specifically to FIG. 4, the mechanism 30 is comprised of a motor driven rotating lint screen 34 within a box frame assembly 36 which attaches to a bulkhead 38 of the dryer at the bulkhead exhaust air opening 20. An adapter pan 41 is provided to secure the box frame assembly 36 to the bulkhead 38.

As described more fully in U.S. Pat. No. 4,314,409, lint laden air exits from the dryer drum 12 and flows through the exhaust air opening 20 entering the rotating cylindrical lint screen 34 from the outside between a cut-off point 46 and a wiper blade 48 depositing lint particles on an outer surface 52 of the lint screen 34. The filtered air continues through the screen and exits longitudinally for passage to the blower unit 26 (FIGS. 2 and 3). The lint screen 34 is rotated in direction shown by arrow 54.

The sump portion 33 is positioned along a portion of the perimeter of the lint screen 34 and has a single opening 56 in the bottom thereof to allow foreign objects to drop down through the opening 56 to keep the sump area clear. The diameter of the hole 56 is approximately the same size as openings 58 in the exhaust air outlet 20 from the drum 12. This ensures that any objects small enough to pass through the openings 58 in the exhaust air outlet will also fall through the sump opening 56 and at the same time allows for a minimum sized opening 56 in the sump.

The means for removing the lint from the outer surface of the lint screen 34 is substantially the same as that described in detail in U.S. Pat. No. 4,314,409. As the lint collects in an area designated by the numeral 63, a rotating auger 62 transports and compacts the lint from the collecting area 63.

FIG. 5 is a cross-sectional view showing the auger 62 and the lint screen 34. The lint screen 34 is rotatably retained within the box frame assembly 36 and is supported by a shoulder 38 (FIG. 8). A top end of the lint screen 34 has a neck portion 40 which protrudes through and frictionally retains a main drive gear 42. The main drive gear 42 meshes with an idler gear 70 which meshes with an auger drive gear 72. A small electric motor 74 directly drives the auger 62 by means of shaft 76. The motor 74 also drives the lint screen 34 by means of gears 72, 70 and 42. The motor speed and gear size arrangement is such that the lint screen cleaner is rotated at approximately four revolutions per minute.

The auger 62 is rotatingly driven by the motor 74 and has a lower end 64 which extends into the cylindrical lint transport tube 32 for removal of lint from the area of the lint screen 34. As the auger 62 moves the lint toward the tube 32 it also compacts the lint into a smaller volume.

During the operation of the dryer 10 heated air enters the interior of the drum 12 through inlet opening 16. Blower means 26 draws warm moist air out of the drum 12 through the exhaust air outlet 20 as shown by arrows 74 (FIG. 4) which after going through the lint screen cleaner and storage mechanism 30 and the blower means 26 exits the machine through discharge port 28. During the drying cycle, occasionally small foreign objects such as hair pins, nails, screws, toothpicks and other such items which are inadvertently left in the clothing being dried are carried with the exhaust air through the small openings 58 in the exhaust air outlet 20 and are pulled toward the lint screen 34. The presence of these foreign objects in the lint cleaner mechanism could cause failure due to jamming of the rotating screen 34 or auger 62. However, since these objects are much heavier than the lint, they tend to fall downwardly when within the box frame assembly 36. Thus, the present invention provides for the sump 33 to be formed in the bottom of the box frame assembly 36 which is of a conical shape to present a large top opening area 55 to catch dislodged foreign objects throughout a wide portion of the circumference of the rotating screen 34 and to also provide a small lower opening 56 through which the foreign objects fall by means of gravity.

Since the blower means 26 creates a low pressure zone within the box frame assembly 36, there is an upward flow of air through the sump 33 as shown by arrow 76 (FIG. 4) which prevents any lint from exiting down through the sump. The small opening 56 provides that only a minimal amount of air will be drawn up through the sump which prevents this stream of air from carrying the foreign objects upwardly but rather allows them to fall down through the upward air stream and to collect in the interior of the cabinet 11 of the dryer. Thus, the sump 33 allows the foreign objects to be discharged from the lint cleaner mechanism 30 while at the same time preventing lint from being discharged along with the foreign objects.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dryer having a cabinet having a drum for tumbling a clothes load and a blower means for circulating heated air through said clothes load to an air flow passage, an automatic lint screen cleaner and storage mechanism for separating lint from said circulating air, said mechanism comprising:

a cylindrical lint screen in said air flow passage, said lint screen having an outer surface for collecting lint carried by said air on said outer surface of said lint screen;

a stationary wiper means mounted adjacent to and in frictional contact with said outer surface for separating said collected lint from said screen;

lint passage means surrounding a portion of said screen for directing said separated lint to a storage container; and a foreign objects sump adjacent said lint screen, said sump in fluid communication with said air flow passage and including a lower portion, said lower portion having wall means forming an opening for the passage of foreign objects into said cabinet from said mechanism, said blower means drawing air from cabinet into said mechanism through said wall means opening.

2. The device of claim 1 wherein said drum has discharge openings for said circulated air and said lower opening in said sump is approximately the same size as said discharge opening in said drum.

3. For use in an automatic clothes dryer having a cabinet, a rotatable drum for carrying a clothes load, a blower means for circulating air through said drum and forming an air flow path, a lint screen cleaner and storage mechanism for removing lint from said air flow comprising:

a box frame housing forming a part of said air flow path between said drum and said blower;

a rotatable lint screen mounted in said box frame;

means for removing collected lint from said lint screen; and sump means adjacent said lint screen for collecting foreign objects carried in said air flow, said sump means being formed as a portion of said box frame and being cone shaped tapering downwardly to a single opening, said blower means creating a low pressure zone in said box frame, whereby air is continuously drawn upwardly through said sump means and collected foreign objects fall downwardly through said opening.

4. The device of claim 3 wherein said drum has a plurality of discharge openings for said circulated air and said sump opening has approximately the same size as one of said discharge openings in said drum.

5. For use in an automatic dryer having a lint collecting mechanism comprising:

a lint screen and wiper blade, a sump positioned adjacent to said lint collecting mechanism to provide a means for removing foreign objects from the area of said mechanism, said sump having a relatively large top opening and small bottom opening, wherein air is drawn upwardly through said bottom opening and collected foreign objects fall downwardly through said sump and through said opening.

* * * * *